US012504023B2

(12) United States Patent
Dong et al.

(10) Patent No.: US 12,504,023 B2
(45) Date of Patent: Dec. 23, 2025

(54) NECK FAN

(71) Applicant: Shenzhen Shiwu Technology Co., Ltd., Shenzhen (CN)

(72) Inventors: Haibo Dong, Shenzhen (CN); Xiangyu Yang, Shenzhen (CN); Hui Liu, Shenzhen (CN)

(73) Assignee: SHENZHEN SHIWU TECHNOLOGY CO., LTD., Shenzhen (CN)

( * ) Notice: Subject to any disclaimer, the term of this patent is extended or adjusted under 35 U.S.C. 154(b) by 247 days.

(21) Appl. No.: 18/211,111

(22) Filed: Jun. 16, 2023

(65) Prior Publication Data

US 2023/0332620 A1 Oct. 19, 2023

(30) Foreign Application Priority Data

Jun. 17, 2022 (CN) ..... 202221526916.7

(51) Int. Cl.

| | |
|---|---|
| ***F04D 29/42*** | (2006.01) |
| ***F04D 17/08*** | (2006.01) |
| ***F04D 25/06*** | (2006.01) |
| ***F04D 25/08*** | (2006.01) |
| ***F04D 25/16*** | (2006.01) |

(52) U.S. Cl.

CPC ..... *F04D 29/4226* (2013.01); *F04D 17/08* (2013.01); *F04D 25/06* (2013.01); *F04D 25/084* (2013.01); *F04D 25/166* (2013.01)

(58) Field of Classification Search

CPC ..... F04D 29/4226; F04D 17/08; F04D 25/06; F04D 25/084; F04D 25/166; F04D 17/16; F04D 25/08; F04D 29/005; F04D 29/403; F04D 29/4206; F04D 29/601; F04D 29/62; F04D 29/624; F04D 29/703

See application file for complete search history.

(56) References Cited

U.S. PATENT DOCUMENTS

2021/0324865 A1* 10/2021 Park ..... F04D 25/084
2023/0130474 A1* 4/2023 Teramoto ..... F04D 29/30 417/423.14

* cited by examiner

*Primary Examiner* — Bryan M Lettman
(74) *Attorney, Agent, or Firm* — HOWARD M COHN and Associates, LLC

(57) ABSTRACT

A neck fan configured to be worn around a neck of a user is provided and includes a fan body. A fan assembly is arranged inside the fan body. The fan assembly comprises a fan, and the fan comprises a first blade set, a second blade set, a hub, and a connection board; the connection board is arranged to surround a circumference of the hub. The first blade set is arranged on a first side of the connection board, the second blade set is arranged on a second side of the connection board, and the second side is opposite to the first side.

17 Claims, 8 Drawing Sheets

NECK FAN

CROSS REFERENCE TO RELATED APPLICATIONS

The present disclosure claims priority of Chinese patent application No. 201920796362.4, filed on May 28, 2019, and Chinese patent application No. 202221526916.7, filed on Jun. 17, 2022, contents of which are incorporated herein by their entireties.

TECHNICAL FIELD

The present disclosure relates to the field of daily life electronics, and in particular to a neck fan.

BACKGROUND

Fans are commonly used by users to keep cool. In the art, there are many small-sized fans available in the market. Although these fans are small-sized, the fans may not be optimally portable and the airflow generated by the fan may not be comfortable for the user.

SUMMARY OF THE DISCLOSURE

The present disclosure provides a fan hung around a neck of a user includes: a main unit. Each of two sides of the main unit is arranged with a soft connection portion, a fan body is arranged at a lower end of the soft connection portion, a side of the fan body defines an air outlet.

The present disclosure provides a neck fan, including a body portion, which is being worn around a neck, and a fan disposed at each of two ends of the body portion, wherein each of two ends of the body portion defines a cavity, a side wall of the body portion defines a side air outlet.

A partition is received in the cavity, the partition divides the cavity into a first cavity and a second cavity, the fan is received in the first cavity, the side air outlet is communicated with the first cavity; the partition comprises a first baffle and a second baffle connected to the first baffle, the first baffle is located above the fan, a length of the first baffle is greater than a half of a diameter of the fan, the side air outlet is defined at a position corresponding to the second baffle, an acute angle is formed between the second baffle and the side wall that defines the side air outlet.

When wind is output out of the neck fan, the wind generated by rotation of the fan is capable of flowing to reach the second baffle and subsequently being sent out of the neck fan through the side air outlet.

DETAILED DESCRIPTION

Technical solutions of the embodiments of the present disclosure will be clearly and completely described by referring to the accompanying drawings. Obviously, the described embodiments are only part of the embodiments of the present disclosure. Based on the embodiments in the present disclosure, other embodiments obtained by any ordinary skilled person in the art without any creative work shall fall within the scope of the present disclosure.

Figure 1:
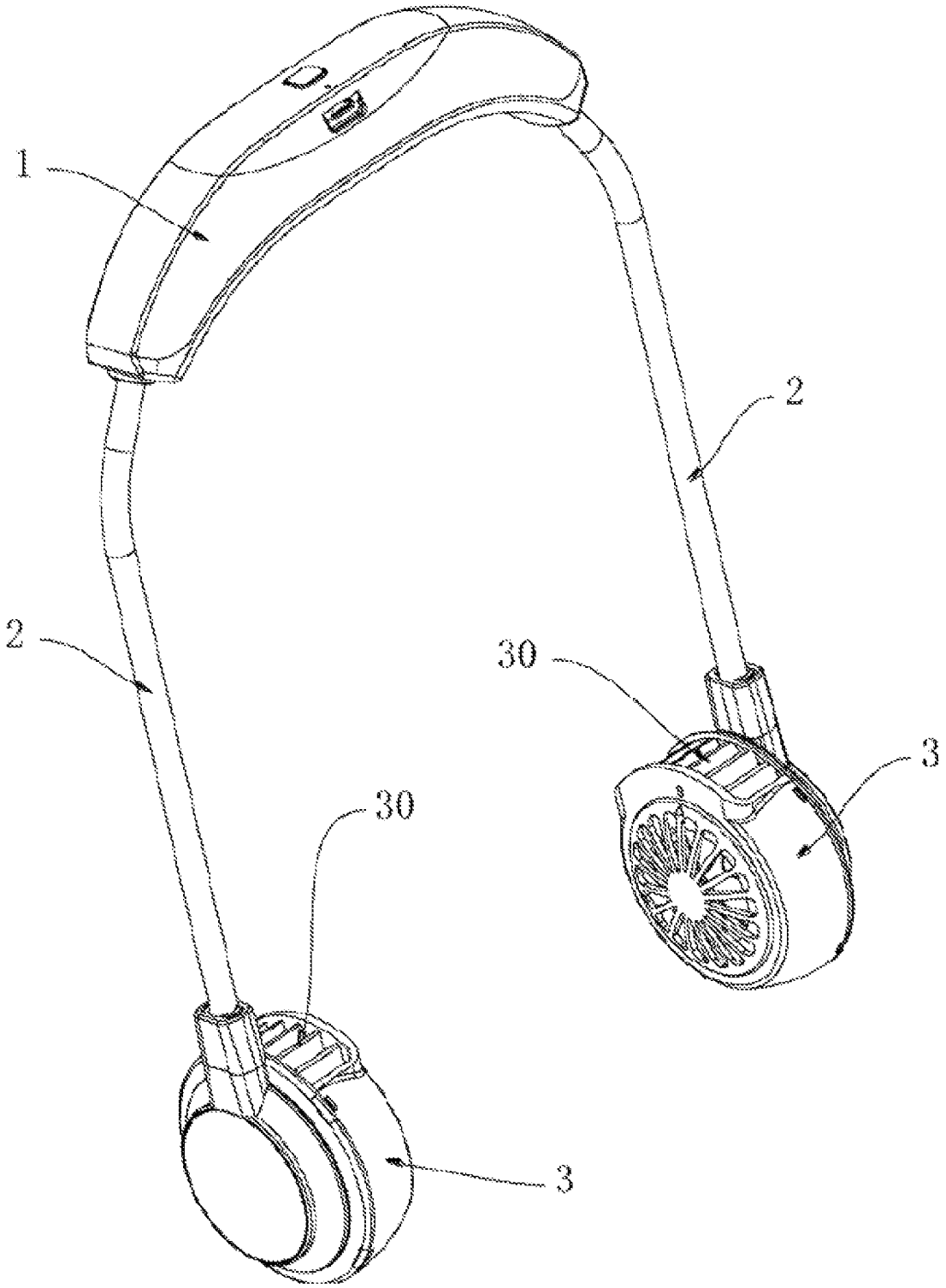
FIG. 1 is a perspective view of the fan according to an embodiment of the present disclosure.
Figure 2:
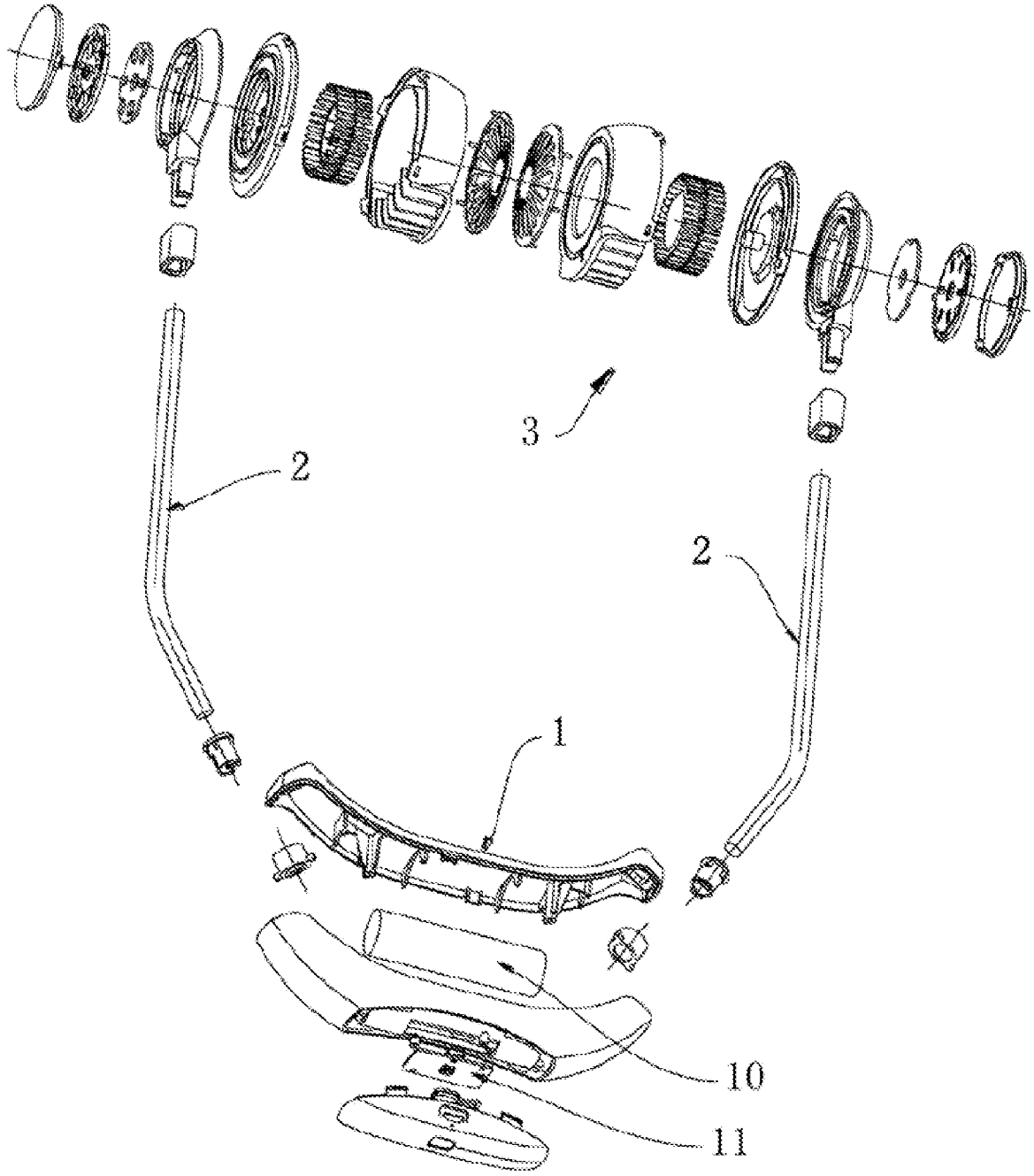
FIG. 2 is an exploded view of the fan according to an embodiment of the present disclosure.
Figure 3:
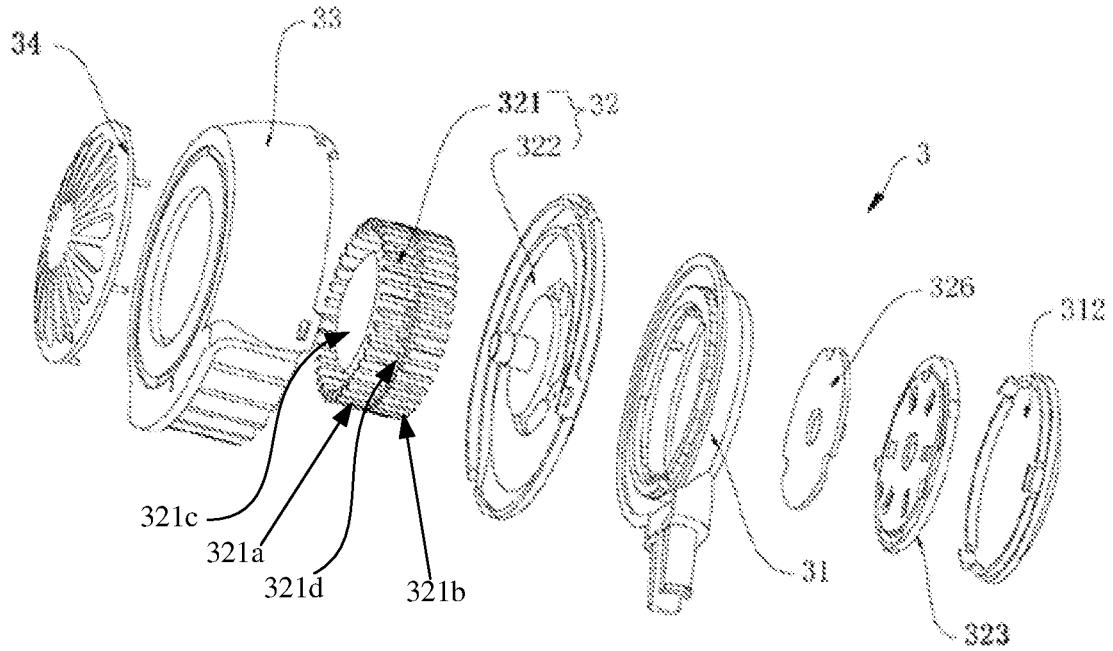
FIG. 3 is an exploded view I of the fan body according to an embodiment of the present disclosure.
Figure 4:
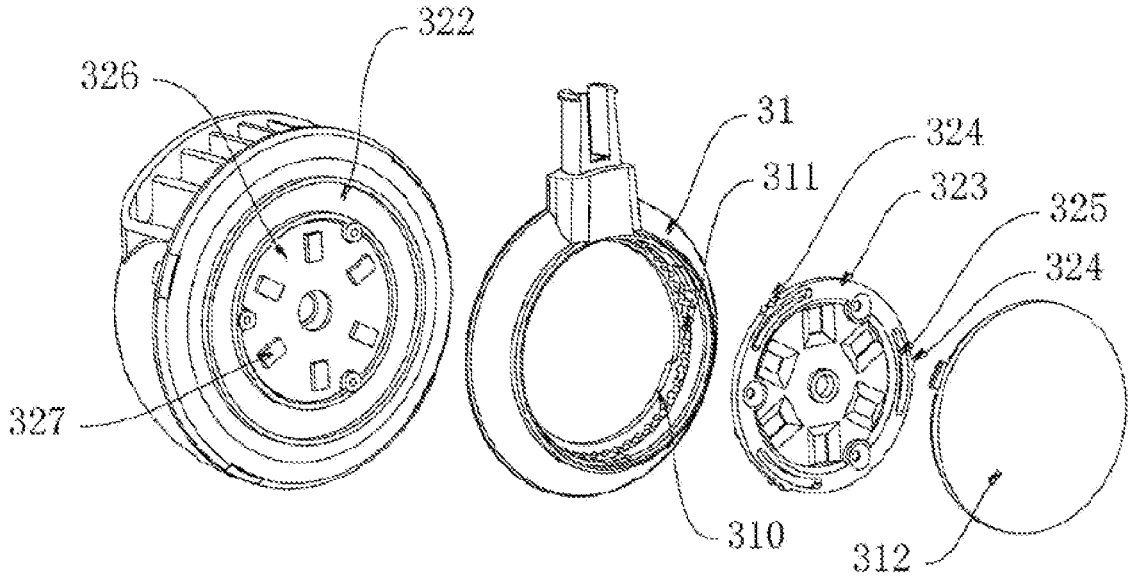
FIG. 4 is an exploded view II of the fan body according to an embodiment of the present disclosure.

The present disclosure provides a fan that can be hung around a neck of a user, as shown in FIG. 1 to FIG. 4. The fan includes a main unit 1. A soft connection portion 2 is connected to each of two ends of the main unit 1. A fan body 3 is arranged at a lower end of the soft connection portion 2. A side portion of the fan body 3 defines an air outlet 30.

In the fan as described in the above, the main unit 1, two soft connection portions 2, and two fan bodies 3 cooperatively form a structural that can be hung around the neck of the user. When the fan is in use, the main unit 1 is placed at a rear side of the neck, and the two fan bodies 3 hang naturally to a front side of the body of the user. When the fan body 3 is operating, air is delivered to the face or the neck of the user, such that air supply is achieved. In addition, when the fan is in use, the fan may not be held by any hand, and the user may work with both hands, such that the fan may be applicable in various application scenarios, demands of the user and the market can be met.

In the present embodiment, the fan body 3 includes a bracket 31. A fan assembly 32 is arranged inside the bracket 31. A housing 33 covers an outer side of the fan assembly 32. An air inlet mesh 34 is fixed to the housing 33. The air inlet mesh 34 faces towards an air inlet side of the fan assembly 32.

In some embodiments, the bracket 31 includes a connection member and is connected to the soft connection portion 2 through the connection member. For example, the connection member may be rod shaped. In some embodiments, the bracket 31 and the soft connection portion may be a one-piece and integral element.

Further, the fan assembly 32 includes a fan (not shown), a fan blade 321, and a base 322. The housing 33 is fixedly connected to the base 322. The fan is mounted on the base 322. A plurality of blades of the fan blade 321 are distributed along a circumference of the fan.

In some embodiments, the base 322 is arranged with a shaft, and the fan is arranged on the shaft.

In some embodiments, the fan assembly 32 includes a fan. The fan includes a first blade set 321*a*, a second blade set 321*b*, a hub 321*c*, and a connection board 321*d*. The connection board 321*d* is arranged to surround a circumference of the hub 321*c*. The first blade set 321*a* is arranged on a first side of the connection board 321*d*, the second blade set 321*b* is arranged on a second side of the connection board 321*d*, and the second side is opposite to the first side. Each of the first blade set 321*a* and the second blade set 321*b* includes a plurality of blades 321. The plurality of blades of the first side are spaced apart from each other and are distributed along an edge of the first side, the plurality of blades of the second side are spaced apart from each other and are distributed along an edge of the second side. The plurality of blades on the first side are misaligned with the plurality of blades on the second side. Specifically, on a plane where the connection board 321*d* is arranged, an orthographic projection of one of the plurality of blades on the first side is located between orthographic projections of two adjacent blades of the plurality of blades on the second side, and the two adjacent blades are disposed near the one of the plurality of blades on the first side.

A shape of each of the plurality of blades of the first side is the same as a shape of each of the plurality of blades of the second side. A size of each of the plurality of blades of the first side is the same as a size of each of the plurality of blades of the second side. A thickness of each of the plurality of blades of the first side is the same as a thickness of each of the plurality of blades of the second side.

The hub 321*c* has an end face protruding from the first side of the connection board 321*d*, and ends of the plurality of blades of the first blade set 321*a* away from the first side of the connection board 321*d* are protruding out of a plane on which the end face of the hub 321*c* is arranged.

In order to adjust an orientation of the air outlet 30 easily, in the present embodiment, the bracket 31 is ring shaped. An inner edge 310 is formed on an inside of the bracket 31. A snap piece 323 is fixed to the base 322. The snap piece 323 is located on the inside of the bracket 31. The inner edge 310 is clamped between the snap piece 323 and the base 322. The snap piece 323, the base 322, and inner edge 310 may operate cooperatively to allow the fan assembly 32 and the housing 33 to rotate relative to the bracket 31.

In an embodiment, a protruding portion 324 is formed at an edge of the snap piece 323. A wavy portion 311 is arranged on an inner wall of the bracket 31. The protruding portion 324 is snapped with the wavy portion 311. When the fan assembly 32 and the housing 33 are rotated to reach a certain position where a preset angle is generated between the fan assembly 32 and the housing 33, the protruding portion 324 and the wavy portion 311 may operate cooperatively to allow the fan assembly 32 and the housing 33 to be fixed at the certain position, such that snapping is achieved.

For example, the housing 33 includes an air inlet portion and a fan covering portion. The air inlet mesh 34 is connected to the air inlet portion. The air inlet portion may define a hole, and the air inlet mesh 34 may define an air inlet opening, such that the air inlet side of the fan assembly 32 may be communicated with the outside of the neck fan through the hole and the air inlet opening. The fan takes the air inlet side to intake air from the outside. Further, when the fan assembly 32 is rotating, wind is generated and is output from the circumference of the blades. The fan covering portion covers the circumference of the blades of the fan assembly 32 and includes a blocking side and an air outlet side. The blocking side is a solid structure and does not define any opening, such that the wind output from the circumference of the blades may hit an inner wall of the housing 33 and cannot be output out of the housing 33 from the blocking side. The air outlet side of the housing 33 defines an opening corresponding to some of the blades of the fan assembly 32 and exposing the some of the blades of the fan assembly 32, such that the wind generated by the some of the blades of the fan assembly 32 can be output from the opening of the air outlet side of the housing 33. In this way, although the entire circumference of the blades can generate wind, all the wind can be directed to the opening of the housing and can be output out of the opening of the housing only.

When rotating the fan assembly 32 and the housing 33, an air outletting direction in which the wind is flowing out of the housing 33 is adjusted. Regardless of how the air outletting direction is adjusted, the air outletting direction is always substantially perpendicular to the direction in which the air is intaken into the fan. Rotating the fan assembly 32 and the housing 33 allows the angle between an extension direction of the soft connection portion 2 and the air outletting direction to be adjusted.

In order to achieve elastic snapping between the protruding portion 324 and the wavy portion 311, in the present embodiment, the snap piece 323 defines an arc-shaped slot 325. The arc-shaped slot 325 extends along the circumference of the snap piece 323, and the protruding portion 324 is aligned with a middle of the arc-shaped slot 325.

In the present embodiment, a light rendering effect is achieved. Specifically, a light plate 326 is fixed to the base 322. The light plate 326 is clamped between the snap piece 323 and the base 322. The light plate 326 is arranged with a plurality of LED chips 327. The snap piece 323 defines a plurality of through holes 328. The plurality of LED chips 327 are aligned to the plurality of through holes 328 in one-to-one correspondence, and each of the plurality of LED chips 327 passes through a corresponding one of the plurality of through holes 328.

In an embodiment, a light-transmitting cover 312 is fixed at the opening of the bracket 31. The light-transmitting cover 312 is located on a side of the bracket 31 away from the base 322. The light-transmitting cover 312 is opposite to the LED chips 327.

In order to achieve power supply and switch control, in the present embodiment, a battery 10 and a control board 11 electrically connected to the battery 10 are arranged inside the main unit 1. A cable is arranged inside the soft connection portion 2. The light board 326 and the fan are electrically connected to the control board 11 via the cable. In this way, a power state of the light board 326 and the fan is controlled through the control board 11.

In an embodiment, the soft connection portion 2 is a flexible tube. Two ends of the soft connection portion 2 are fixedly connected to the main unit 1 and the bracket 31 respectively.

The above description shows only preferred embodiments of the present disclosure and is not intended to limit the present disclosure. Any modification, equivalent replacement or improvement made within the technical scope of the present disclosure shall be included in the scope of the present disclosure.

Figure 5:
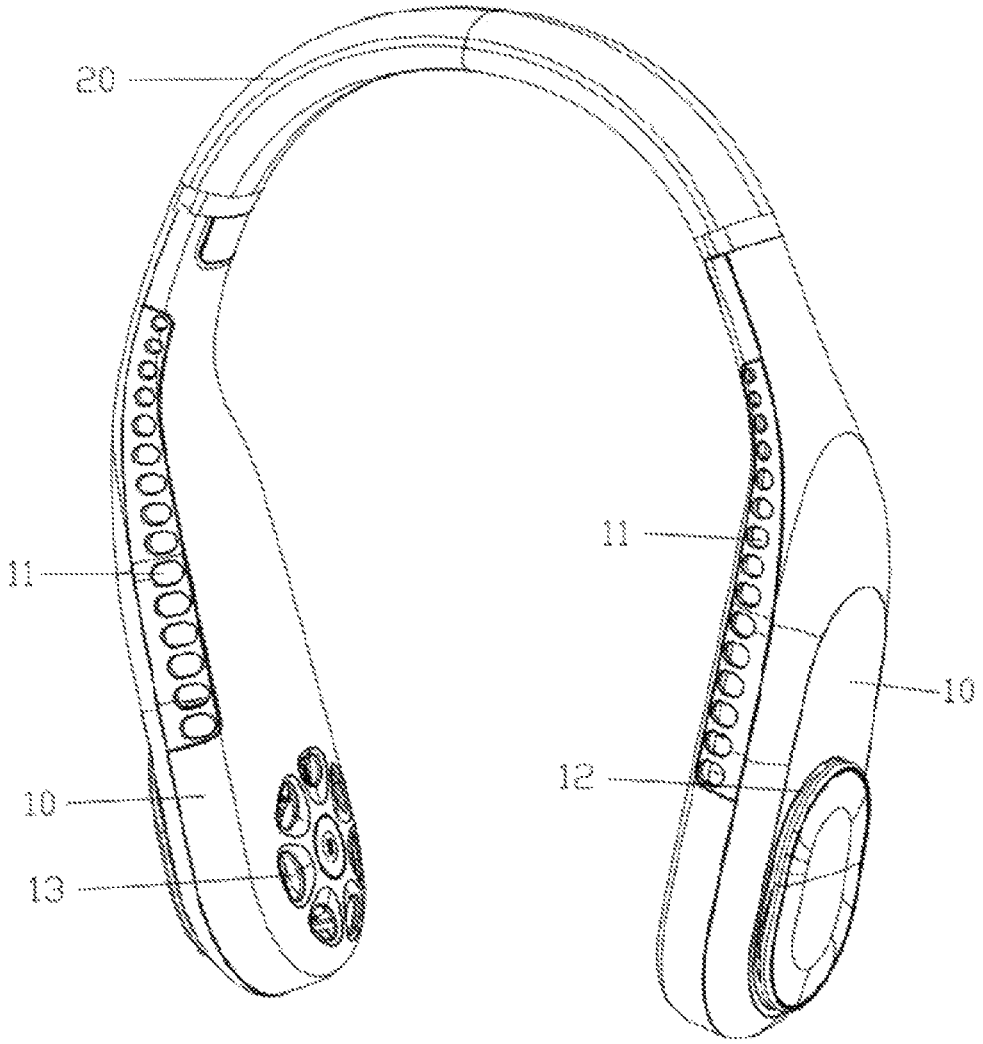
FIG. 5 is a perspective view of the neck fan according to an embodiment of the present disclosure.
Figure 6:
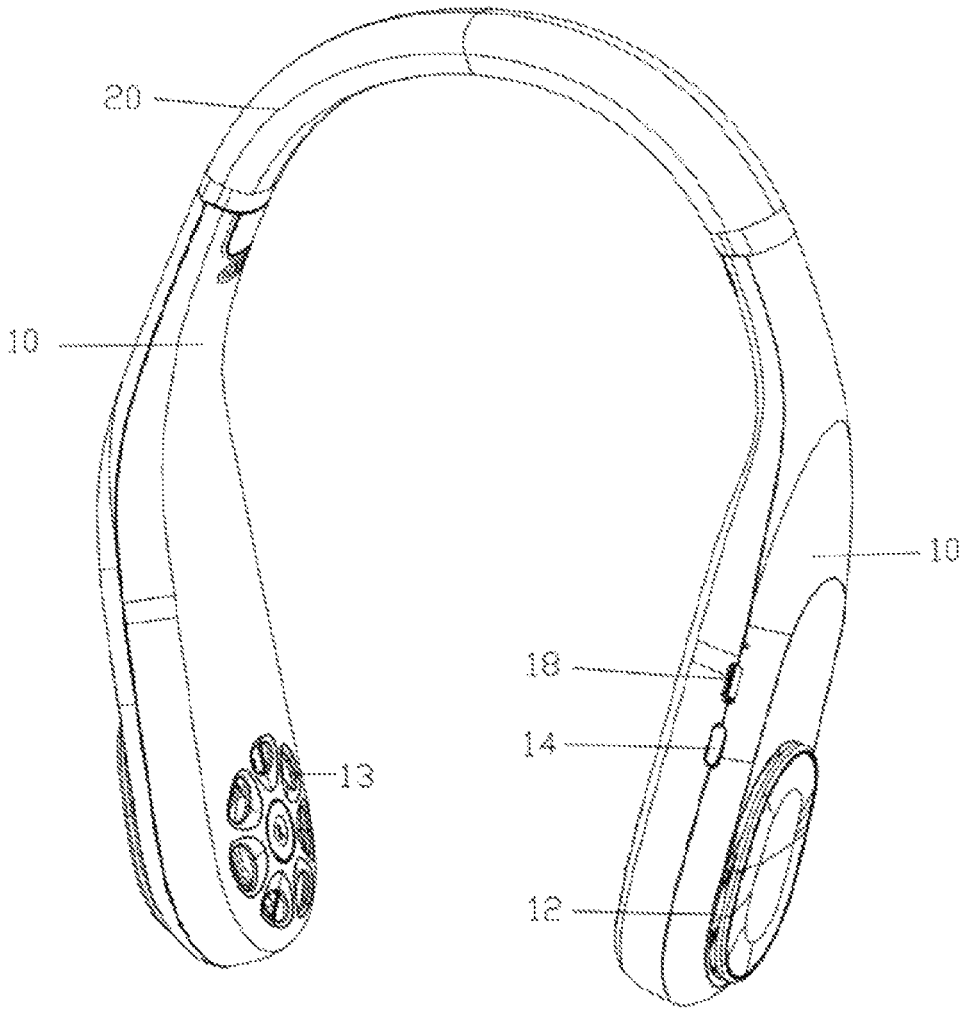
FIG. 6 is another perspective view of the neck fan, viewed from another viewing angle, according to an embodiment of the present disclosure.
Figure 7:
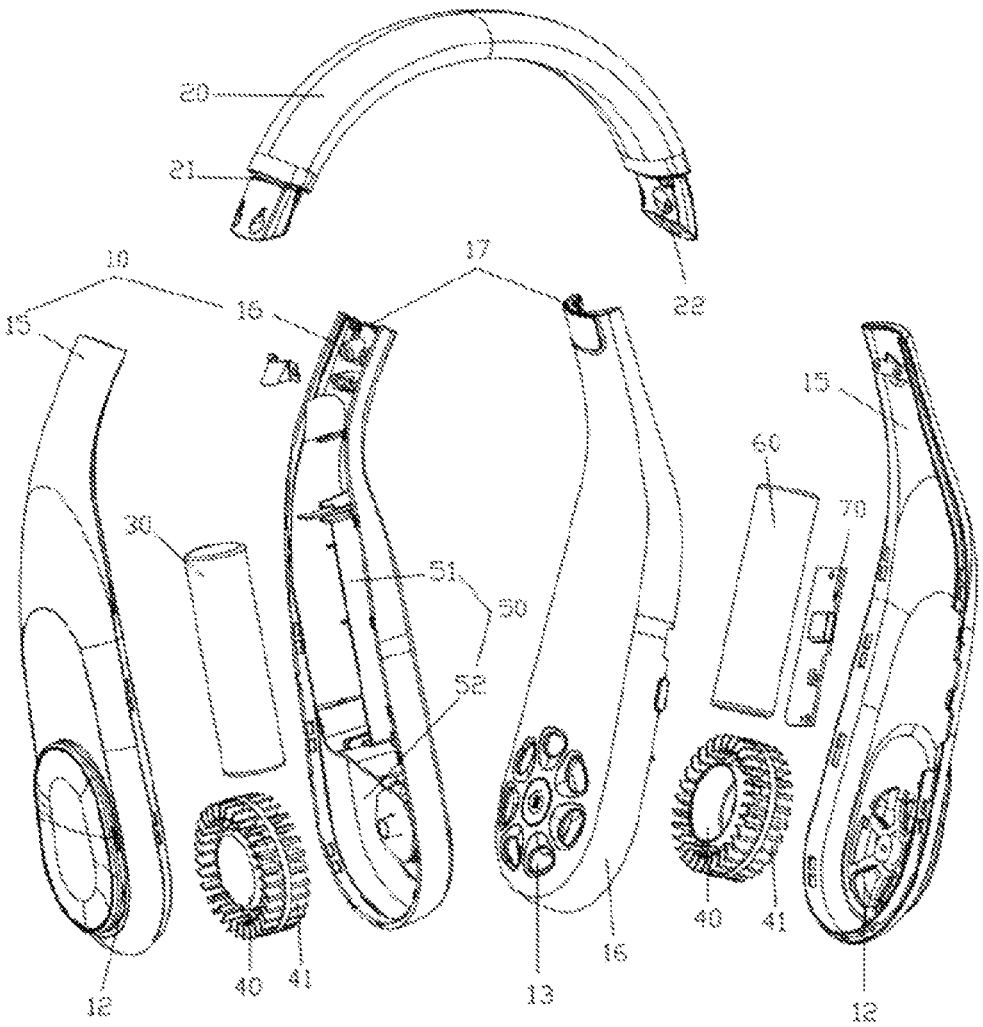
FIG. 7 is an explosive view of the neck fan according to an embodiment of the present disclosure.
Figure 8:
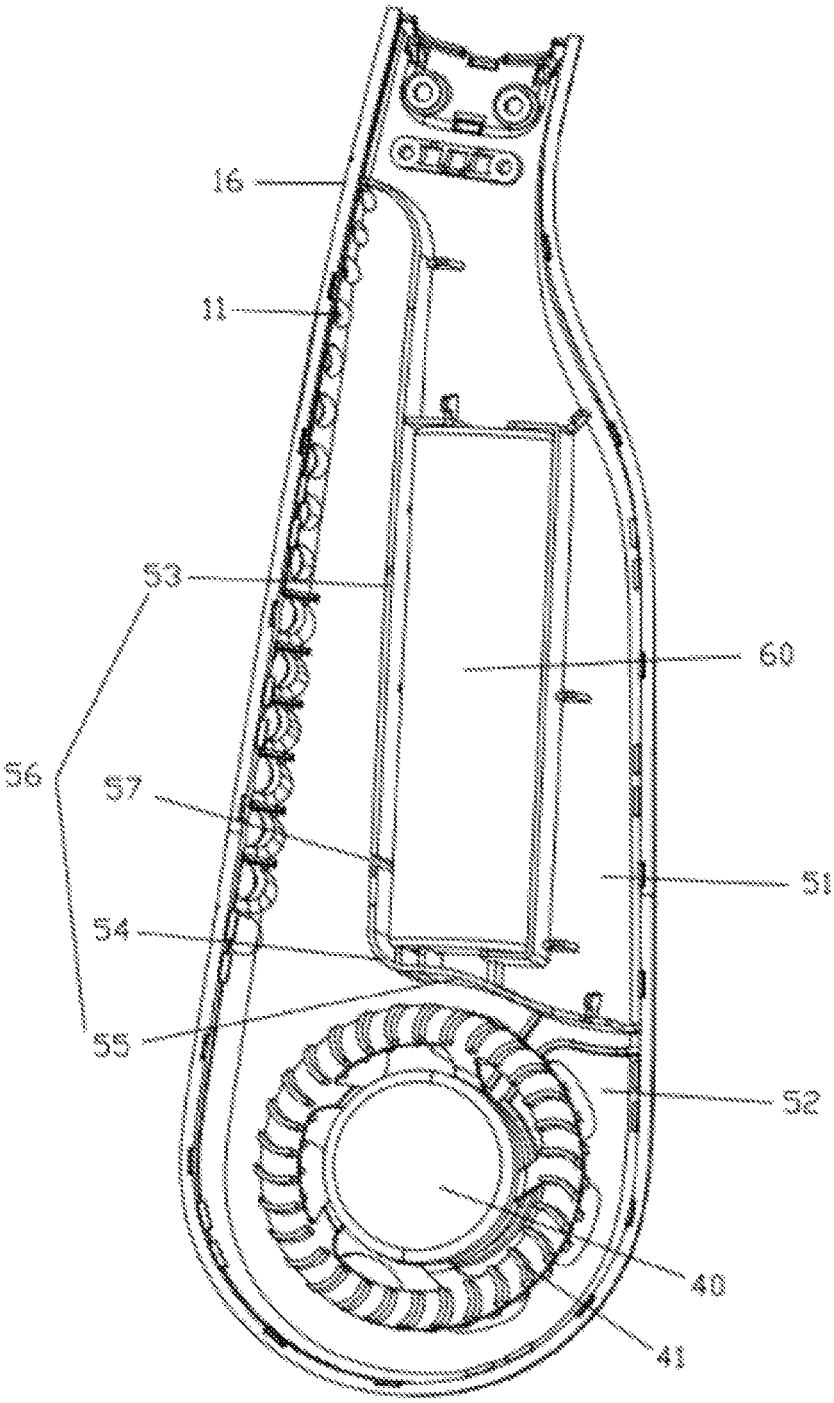
FIG. 8 is a schematic view of the second battery and the fan mounted on the inner shell according to an embodiment of the present disclosure.
Figure 9:
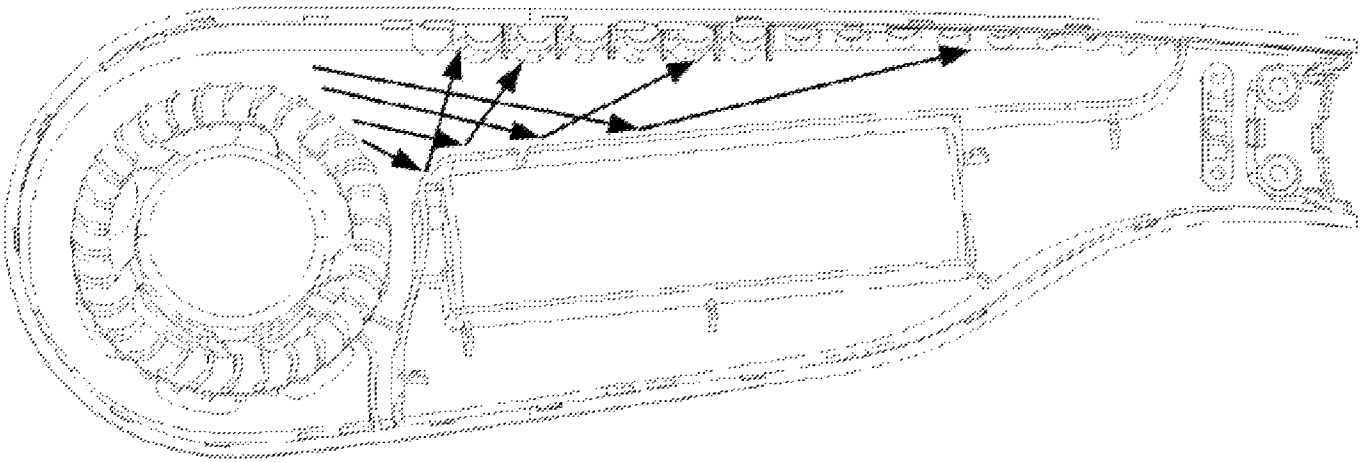
FIG. 9 is a schematic view of a flowing direction of the air after entering the neck fan according to an embodiment of the present disclosure.

As shown in FIG. 5 to FIG. 9, the present disclosure provides a neck fan including a body portion and a fan disposed at each of two ends of the body portion. The body portion is being worn around the neck. Each of two ends of the body portion defines a cavity 50. A side wall of the body portion defines a side air outlet 11. A partition 56 is received in the cavity 50. The partition 56 divides the cavity 50 into a first cavity 51 and a second cavity 52. The fan is received in the first cavity 51. The side air outlet 11 is communicated with the first cavity 51. The partition 56 includes a first baffle 55 and a second baffle 53 connected to the first baffle 55, The first baffle 55 is located above the fan, and a length of the first baffle 55 is greater than a half of a diameter of the fan. The side air outlet 11 is defined at a position corresponding to the second baffle 53. An acute angle is formed between the second baffle 53 and the side wall that defines the side air outlet 11. When the air is output out of the neck fan, wind generated by rotation of the fan flows to reach the second baffle 53 and is subsequently sent out of the neck fan through the side air outlet 11.

Since the wind generated by rotation of the fan is blocked by the second baffle 53 and is subsequently sent out from the side air outlet, strength of the airflow can be reduced. The wind may flow out of the side air outlet 11 more gently, acting like the natural wind. Strength that the wind flows out of the side air outlet 11 to impact on the skin of the user may be reduced, improving the comfort of the user in using the neck fan of the present disclosure for cooling.

Specifically, the angle between the second baffle 53 and the side wall that defines the side air outlet 11 is less than 45 degrees, and preferably, the angle may be 5-15 degrees. In this way, the wind generated by the fan is reflected by the second baffle 53 to be sent out directly from the side air outlet 11.

In an embodiment, the second baffle 53 defines a diversion port 57 to allow the first cavity 51 to be communicated with the second cavity 52. The diversion port 57 is defined at a position corresponding to the side air outlet. The wind generated by the fan passes through the diversion port 57, such that the wind generated by the fan may be dispersed, and the strength of the air flowing out of the side air outlet 11 may be reduced.

In an embodiment, the first baffle 55 is connected to the second baffle 53 by a chamfered corner 54. The wind generated by the fan is blocked by the chamfered corner 54 and is further flowing out of the side air outlet 11.

In an embodiment, in order to allow the wind generated by the fan to reach the second baffle 53, the fan includes an impeller 40 and an electric motor (not shown in the drawings) connected to the impeller 40. A cross section of a blade 41 of the impeller 40 is arc shaped, and an opening of the arc faces upwardly.

For example, a plurality of blades 41 are arranged around a circumference of a shaft of the impeller 40. The plurality of blades 41 have a same curvature. For one of plurality of blades 41 disposed near the first baffle 55, a surface of the blade 41 is curved towards a side of the side wall that defines the air outlets 11. For one of plurality of blades 41 disposed near side of the side wall that defines the air outlets 11, a surface of the blade 41 is curved away from the first baffle 55. In some embodiments, the surface of the blade may be curved in other ways, as long as the wind generated by the fan can flow towards the second baffle 53.

In an embodiment, in order to improve compactness of the structure of the neck fan, a middle of the first baffle 55 is recessed towards the second cavity 52 to form a curved surface. A curvature of the curved surface is adaptive to a curvature of a circumference of the fan corresponding to the curved surface. A first battery 60 and a circuit board 70 are received in the second cavity 52 at one of two ends of the body portion. The motor, the first battery 60, and the fan are electrically connected to the circuit board 70. The two ends of the body portion include a first end and a second end, each of the first end and the second end has a first side wall and a second side opposite to the first side wall. The first side wall of the first end is opposite to the first side wall of the second end. Each of the first side wall of the first end and the first side wall of the second end defines a first air outlet 13, and the first air outlet 13 is located corresponding to the fan and is communicated with the first cavity 51. Each of the second side wall of the first end and the second side wall of the second end defines an air inlet 12.

For example, the first baffle 55 includes two ends. One of the two ends is connected to the second baffle 53, and the other one of the two ends is connected to a side of the side wall away from the side air outlet 11. That is, the first baffle 55 is spaced apart from the fan and extends along and follows at least a part of the circumference of the fan. The second baffle 53 has two ends. One of the two ends is connected to the first baffle 55, and the other one of the two ends is connected to a side of the side wall near the side air outlet 11. In an embodiment, the side wall defines a plurality of air outlets 11, distributing along a direction from a side of the side wall near the fan to a side of the side wall away from the fan. A distribution direction of the plurality of air outlets 11 is the same as an extension direction of the second baffle 53. The number of diversion port 57 may be one or more. When one diversion port 57 is defined, the diversion port 57 may be defined to correspond to one of the plurality of air outlets 11 near the fan.

In an embodiment, in order to increase a running time length of the neck fan of the present disclosure, a second battery 30, which is electrically connected to the circuit board 70, is received in the second cavity 52 of the other one of the two ends of the body portion. The first battery 60 and the second battery 30 are disposed at the two ends of the body portion, and therefore, weights of the two ends of the neck fan may be balanced.

In an embodiment, in order to facilitate manufacturing of the neck fan of the present disclosure, the body portion includes a connection member 20 and an air outlet structure 10 disposed at each of two ends of the connection member 20. The air outlet structure 10 includes an inner shell 16 and an outer shell 15 connected to the inner shell 16, and the inner shell 16 and the outer shell 15 cooperatively define the cavity 50. The partition 56, the fan, the air inlet 12, the side air outlet are located on the inner shell 16. The first air outlet 13 is located on the outer shell 15. Each of the two ends of the connection member 20 is arranged with a catch 21. Both the inner shell 16 and the outer shell 15 or one of the inner shell 16 and the outer shell 15 is arranged with a protrusion 17. The protrusion 17 is arranged inside the catch 21. The connection member 20 defines a wiring hole 22 communicated with the second cavity 52. The partition 56 and the inner shell 16 may be moulded as a one-piece and integral member. The inner shell 16 may be fixed to the outer shell 15 by a screw, gluing or a snap, and the connection member 20 is fixedly mounted. Specifically, the connection member 20 may be made of soft rubber, such as silicone.

The air outlet structure 10 is arranged with a switch button 14 and a charging interface 18 electrically connected to the circuit board 70. The switch button 14 may be pressed to turn on the fan through the circuit board 70. The fan may be connected to the power supply through the charging interface 18, and the first battery 60 and the second battery 30 may be charged through the circuit board 70.

The above embodiments of the present disclosure are merely examples for clearly illustrating the present disclosure, and are not intended to limit the present disclosure. Any obvious variation or change that falls within the substantial spirit of the present disclosure shall be within the scope of the present disclosure.

What is claimed is:

1. A neck fan, configured to be worn around a neck of a user, the neck fan comprising:

a connection portion and a fan body connected to each of two ends of the connection portion, wherein, the connection portion is capable of being disposed at a rear side of the neck, and the fan body is capable of being disposed at the front side of the neck;

a fan assembly is arranged inside the fan body; and a wall of the fan body defines an air inlet and an outlet, and the fan assembly is configured to intake air from the air inlet and to generate wind, and the wind is capable of flowing out of the neck fan through the air outlet, wherein the fan body comprises a bracket, a fan assembly comprising the fan and the fan body is arranged inside the bracket, a housing covers an outer side of the fan assembly, an air inlet mesh is fixed to the housing, the air inlet mesh faces towards an air inlet side of the fan assembly, and wherein the bracket is ring shaped, an inner edge is formed at an inside of the bracket, a snap piece is fixed to the base, the snap piece is located at the inside of the bracket, the inner edge is clamped between the snap piece and the base; and the snap piece, the base, and inner edge operate cooperatively to allow the fan assembly and the housing to rotate relative to the bracket.

2. The neck fan according to claim 1, wherein at least one of the following features are met:

the wall of the fan body defines a cavity, a partition is received in the cavity, the partition divides the cavity into a first cavity and a second cavity, the fan assembly is received in the first cavity;

the air outlet comprises a side air outlet, the side air outlet is communicated with the first cavity; the partition comprises a first baffle and a second baffle connected to the first baffle, the first baffle is spaced apart from the fan assembly and extends to surround at least a part of circumference of the fan assembly, the side air outlet is defined at a position corresponding to the second baffle, an acute angle is formed between the second baffle and a part of the wall that defines the side air outlet; and the wind generated by the fan assembly is capable of flowing to reach the second baffle and subsequently being sent out of the neck fan through the side air outlet;

the second baffle defines a diversion port to allow the first cavity to be communicated with the second cavity, and the diversion port is defined at a position corresponding to the side air outlet;

the first baffle is connected to the second baffle by a chamfered corner;

the first baffle is recessed away from the fan assembly to form a curved surface, and a curvature of the curved surface is adaptive to a curvature of a circumference of the fan assembly corresponding to the curved surface;

the air outlet comprises a first air outlet, communicated with the first cavity; a direction in which the air is intaken from the air inlet into the first cavity is substantially parallel to a direction in which the wind is flowing out through the first air outlet and is substantially perpendicular to a direction in which the wind is flowing out through the side air outlet;

the fan assembly comprises an impeller and a motor connected to the impeller, a cross section of a blade of the impeller is in a shape of an arc, and an opening of the arc faces upwardly;

a battery and a circuit board are received in the second cavity; and the motor, the battery, and the fan assembly are electrically connected to the circuit board; and the first air outlet defined in the fan body connected to one of the two ends of the connection portion faces towards the first air outlet defined in the fan body connected to the other one of the two ends of the connection portion.

3. The neck fan according to claim 1, wherein, the fan assembly comprises a fan, and the fan comprises a first blade set, a second blade set, a hub, and a connection board; the connection board is arranged to surround a circumference of the hub; and the first blade set is arranged on a first side of the connection board, the second blade set is arranged on a second side of the connection board, and the second side is opposite to the first side.

4. The neck fan according to claim 3, wherein, each of the first blade set and the second blade set comprises a plurality of blades;

the plurality of blades of the first side are spaced apart from each other and are distributed along an edge of the first side, the plurality of blades of the second side are spaced apart from each other and are distributed along an edge of the second side;

the plurality of blades on the first side are misaligned with the plurality of blades on the second side; and on a plane where the connection board is arranged, an orthographic projection of one of the plurality of blades on the first side is located between orthographic projections of two adjacent blades of the plurality of blades on the second side, and the two adjacent blades are disposed near the one of the plurality of blades on the first side.

5. The neck fan according to claim 4, wherein, a shape of each of the plurality of blades of the first side is the same as a shape of each of the plurality of blades of the second side;

a size of each of the plurality of blades of the first side is the same as a size of each of the plurality of blades of the second side; and a thickness of each of the plurality of blades of the first side is the same as a thickness of each of the plurality of blades of the second side.

6. The neck fan according to claim 4, wherein, the hub comprises an end face protruding from the first side of the connection board, and ends of the plurality of blades of the first blade set away from the first side of the connection board are protruding out of a plane on which the end face of the hub is arranged.

7. The neck fan according to claim 3, wherein the fan assembly further comprises a base, and the fan is mounted on the base.

8. The neck fan according to claim 1, wherein each of the two ends of the connection portion is arranged with a catch, the fan body is arranged with a protrusion, the protrusion is connected to the catch; and each of the two ends of the connection portion defines a wiring hole communicated with the second cavity.

9. The neck fan according to claim 1, wherein the fan assembly comprises the fan comprising a fan blade, and a base; the housing is fixedly connected to the base, the fan is mounted on the base, a plurality of blades of the fan blade are distributed along a circumference of the fan.

10. The neck fan according to claim 1, wherein a protruding portion is formed at an edge of the snap piece, a wavy portion is arranged on an inner wall of the bracket, the protruding portion is snapped with the wavy portion.

11. The neck fan according to claim 10, wherein the snap piece defines an arc-shaped slot, the arc-shaped slot extends along the circumference of the snap piece, and the protruding portion is aligned with a middle of the arc-shaped slot.

12. The neck fan according to claim 1, wherein a light plate is fixed to the base, the light plate is clamped between the snap piece and the base, the light plate is arranged with a plurality of LED chips, the snap piece defines a plurality of through holes, and the plurality of LED chips are aligned to the plurality of through holes in one-to-one correspondence, and each of the plurality of LED chips passes through a corresponding one of the plurality of through holes.

13. The neck fan according to claim 12, wherein a light-transmitting cover is fixed at an opening of the bracket, the light-transmitting cover is located on a side of the bracket away from the base, and the light-transmitting cover is opposite to the plurality of LED chips.

14. The neck fan according to claim 12, wherein a battery and a control board electrically connected to the battery are arranged inside the main unit, a cable is arranged inside the connection portion, the light board and the fan are electrically connected to the control board via the cable, and a power state of the light board and the fan is controlled through the control board.

15. A neck fan, configured to be worn around a neck of a user, the neck fan comprising:

a fan body, wherein, a fan assembly is arranged inside the fan body;

the fan assembly comprises a fan, and the fan comprises a first blade set, a second blade set, a hub, and a connection board; the connection board is arranged to surround a circumference of the hub; and the first blade set is arranged on a first side of the connection board, the second blade set is arranged on a second side of the connection board, and the second side is opposite to the first side, wherein the fan body comprises a bracket, a fan assembly comprising the fan and the fan body is arranged inside the bracket, a housing covers an outer side of the fan assembly, an air inlet mesh is fixed to the housing, the air inlet mesh faces towards an air inlet side of the fan assembly, and wherein the bracket is ring shaped, an inner edge is formed at an inside of the bracket, a snap piece is fixed to the base, the snap piece is located at the inside of the bracket, the inner edge is clamped between the snap piece and the base; and the snap piece, the base, and inner edge operate cooperatively to allow the fan assembly and the housing to rotate relative to the bracket.

16. The neck fan according to claim 15, wherein, each of the first blade set and the second blade set comprises a plurality of blades; the plurality of blades of the first side are spaced apart from each other and are distributed along an edge of the first side, the plurality of blades of the second side are spaced apart from each other and are distributed along an edge of the second side; the plurality of blades on the first side are misaligned with the plurality of blades on the second side; and on a plane where the connection board is arranged, an orthographic projection of one of the plurality of blades on the first side is located between orthographic projections of two adjacent blades of the plurality of blades on the second side, and the two adjacent blades are disposed near the one of the plurality of blades on the first side;

and/or, a shape of each of the plurality of blades of the first side is the same as a shape of each of the plurality of blades of the second side; a size of each of the plurality of blades of the first side is the same as a size of each of the plurality of blades of the second side; a thickness of each of the plurality of blades of the first side is the same as a thickness of each of the plurality of blades of the second side.

17. The neck fan according to claim 15, wherein, the hub comprises an end face protruding from the first side of the connection board, and ends of the plurality of blades of the first blade set away from the first side of the connection board are protruding out of a plane on which the end face of the hub is arranged;

and/or the fan assembly further comprises a base, and the fan is mounted on the base.

* * * * *